United States Patent [19]

Scribner

[11] 4,444,346

[45] Apr. 24, 1984

[54] PNEUMATIC FEEDER FOR PUNCH PRESSES

[76] Inventor: Albert W. Scribner, 6 Country Club Rd., Darien, Conn. 06820

[21] Appl. No.: 353,328

[22] Filed: Mar. 1, 1982

[51] Int. Cl.[3] ..... B65H 17/36; B65H 17/44

[52] U.S. Cl. ..... 226/162; 226/150

[58] Field of Search ..... 226/162, 158, 150, 142, 226/166, 123

[56] References Cited

U.S. PATENT DOCUMENTS

| | | | |
|---|---|---|---|
| 2,622,874 | 12/1952 | Haller | 226/150 |
| 3,038,645 | 6/1962 | Nordlof | 226/162 X |
| 3,157,334 | 11/1964 | Bunnell et al. | 226/162 X |
| 3,329,327 | 7/1967 | Scribner | 226/150 |
| 4,160,518 | 7/1979 | Scribner | 226/162 X |

*Primary Examiner*—Stuart S. Levy
*Assistant Examiner*—Scott J. Haugland

[57] ABSTRACT

A pneumatically operated stock feeder for intermittently advancing stock into the work station of a punch press or the like and having an improved pneumatic control arrangement which incorporates three interconnected valves, namely a main three-way valve, an inlet pressure responsive valve means and a fluid pressure controlled exhaust valve means, for controlling the proper sequencing of the fluid motors that respectively produce the stock gripping, clamping and feeding actions of the feeder. The combination of the two pressure responsive sequence valve means control the operation of the main feed motor and are in turn controlled by the output of the main control valve; this control arrangement affording a high level of feed accuracy yet tolerating a relatively wide range of operator set-up inaccuracies and speed changes without significantly adversely affecting such feed accuracy.

2 Claims, 9 Drawing Figures

PNEUMATIC FEEDER FOR PUNCH PRESSES

BACKGROUND OF THE INVENTION

Pneumatic feeders of the type shown in my U.S. Pat. No. 3,329,327 have relied on the use of a variable air flow restriction in the pressure fluid (air) conducting line to the head end of the main cylinder in order to afford not only feed speed adjustments but also the time delay action needed for sequencing the execution of the stock gripping and clamping actions with respect to the stock feeding action of the feeder.

Although this arrangement has for the most part given satisfactory results further control refinements are desireable to accommodate some of the current operational and user requirements. Furthermore all air feeds have certain set up requirements such as the need for (a) proper synchronization of the feeder operation with the press operation, and (b) the capacity for fine adjustment of the feed stroke length which in many cases must be very precisely made particularly in connection with high and/or exacting performance operations and which can be tedious to manually establish. Thus it is desireable to maximize these aspects of air feed construction and operation.

SUMMARY OF THE INVENTION

The present invention is an improvement on the air feed disclosed in my said prior patent and contemplates the provision of an improved pneumatic control system that incorporates a normally closed main control valve in combination with a pair of pressure responsive valves for properly sequencing the flow of pressure fluid (a) to and from the stock gripping and clamping motors and (b) to and from the main feed motor of the feeder. The two pressure responsive valves are adapted and arranged so as to be coupled with the output line of the main control valve so that pressure fluid may be directed to the stock gripping and clamping fluid motors and thereafter also through at least one of said pressure responsive valves to the main feed cylinder in response to the opening of said main valve for thereby producing an index stroke of the feeder, and so that pressure fluid from said stock gripping and clamping fluid motors may be exhausted through said main valve and pressure fluid from the main cylinder may thereafter in response to the closing of said main valve also be exhausted through a separate exhaust line that includes the other pressure responsive valve, but not the main valve, for thereby producing a feed stroke of the feeder.

The primary object of the invention is to provide a novel and improved control arrangement for a pneumatic feeder of the type shown in my said prior Patent, which control arrangement will improve the speed capabilities and also the set-up adjustment tolerances of the feeder while still maintaining a high level of feed accuracy during the operation of the feeder.

Another object of the invention is to provide a novel structural and operational combination for a main valve and two pressure responsive valve means in a feeder control circuit.

A further object of the invention is to provide a novel structural arrangement for two pressure responsive valves in a feeder control circuit whereby one of these two valves is carried by the other.

Other objects of the invention will become apparent as the disclosure proceeds.

DETAILED DESCRIPTION OF THE INVENTION

Figure 2:
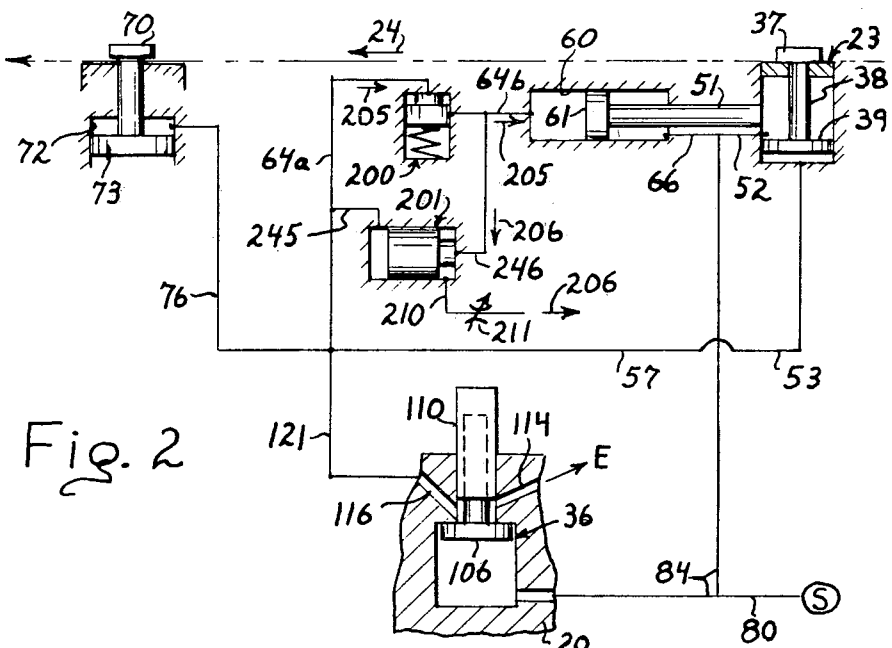
FIG. 2 is a circuit diagram illustrating the improved control arrangement contemplated for the present feeder.

The disclosure in my said prior Patent and the construction and operation of the feeder covered by said Patent and now commercially offered for sale by P/A Industries of Bloomfield, Conn. are incorporated herein by reference and a brief review will first be made of the operation of that feeder with particular reference to FIG. 1 of this application which corresponds to FIG. 13 of said Patent. The single normally closed three-way main valve means 36 is adapted when in a first or normally closed upper operative condition to exhaust fluid pressure therethrough from all five fluid motors, namely the two double-acting stock gripping motors which are designated in FIGS. 1 and 2 and will hereinafter be referred to by the reference numeral 39, the two single-acting stock clamping motors which are designated in FIGS. 1 and 2 and will hereinafter be referred to by the reference numeral 73, and the main double-acting fluid motor 60, 61, so as to thereby permit the continuous fluid pressure biasing action on the rod ends of said double-acting main and stock gripping fluid motors to produce a stock feeding stroke of the feed slide 23. When the plunger 110 of the main valve means 36 is depressed by the downward movement of the press ram so that said valve means assumes its second or open operative condition pressure fluid will be supplied simultaneously through the output line 121 of the main valve means 36 to all five of said fluid motors so as to thereby produce an index or non-feed stroke of the feed slide 23 against the said continuous biasing action. In practice a restriction such as indicated at 78 in the air line 64 to the head end of the main cylinder has been provided and has been relied upon not only to control the speed of stock feed movement of the feed slide but also to produce a short time delay between initiation of operation of the four stock clamping and gripping motors 73, 39 and the initiation of operation of the main fluid motor 60, 61; which delay is necessary to insure (a) the proper sequencing of the grip, clamp and feed actions and (b) consistency in the stock feeding operation of the feeder. The feed accuracy produced by this type of control system may however decrease somewhat under certain performace and/or set-up requirements for the feeder.

The present invention contemplates a control arrangement that not only improves the accuracy and other functional characteristics of the feeder described in said Patent but also makes such improved characteristics possible over a relatively wide tolerance range of manual set up inaccuracies by the press operator. This improved control arrangement will now be described in connection with FIGS. 2–4 of the present drawings; any reference numerals used therein that are the same as those used in said Patent designating the same or similar parts, and except where otherwise indicated the structure for the feeder contemplated herein, will be substantially the same as that shown and described in said Patent.

FIG. 2 illustrates the improved control circuit arrangement wherein three control valves are provided in combination, namely the main normally closed three-way valve means 36, a novel pressure responsive fluid inlet or one-way valve 200 and a novel pressure responsive differential exhaust valve 201. The two pressure responsive valves 200 and 201 are connected between the control line 64*a* (corresponding to line 64 of FIG. 1) and the head end of the main fluid motor means 60, 61 and thus are pressure operated under the control of the output line 121 of the main valve means 36. The two valves 200 and 201 and their associated fluid conduit lines are physically located in any suitable position in the main body 20 of the feeder and the structural and functional details of these two valves will be discussed in connection with FIGS. 3 and 4. From the FIG. 2 circuit diagram it will be seen that the inlet valve 200 serves generally in the cirucit to permit inlet flow (as indicated by arrows 205) of pressure fluid from the output line 121 of the main valve through line 64*a*, 64*b* to the head end of the main fluid motor means 60, 61 in response to a rising fluid pressure in said main valve output line 121, while the differential pressure exhause valve 201 serves generally in the circuit to permit the exhaust flow (as indicated by arrows 206) of pressure fluid from said main fluid motor means 60, 61 out through a separate exhaust line 210 to the atmosphere in response to a lowering fluid pressure in the said output line 121. In this way the main fluid motor means 60, 61 will not initiate movement of the feed slide until a short time after the stock clamping and gripping means 70 and 39 respectively have been appropriately set as is required for accurate feed operations. A variable restriction 211 is operatively disposed in the line 210 and includes the usual manually settable threaded member which may be adjusted to control the speed of feed movement of the feed slide in a feed direction as is well understood in the art.

Figure 3:
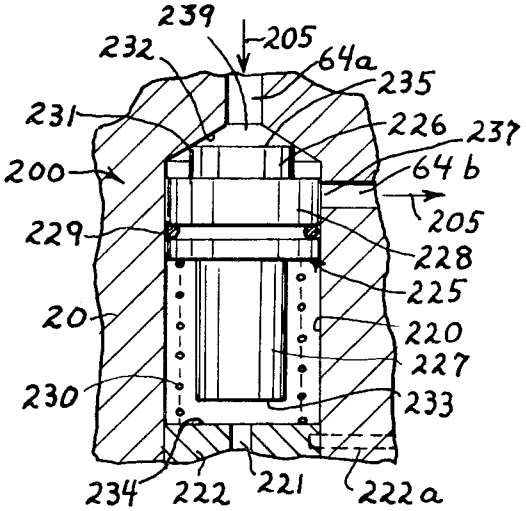

The structural and functional details of the novel one-way inlet or supply valve 200 will now be described in connection with FIG. 3 wherein a cylindrical valving chamber 220 is shown formed in the main feeder body 20, the upper end of chamber 220 as seen in FIG. 3 being connected to both the line 64*a* and the line 64*b* while the other or lower end of said chamber communicates with the atmosphere through any suitable vent line such as 221 formed in the chamber end plug 222 fixed at and defining the lower end of chamber 220. A generally cylindrical valving member 225 is disposed in said chamber 220 for axial movement between a first normal or upper operative position shown in FIG. 3 wherein pressure fluid is prevented from flowing from the main fluid motor means back through said chamber and into line 64*a*, and a second or lower operative position wherein pressure fluid may flow from line 64*a* through the upper portion of chamber 220 to line 64*b* and thus to the head end of the main fluid motor means. The valve member 225 is circular in cross sectional profile and has reduced upper and lower ends 226 and 227 respectively while the central portion 228 thereof is provided with a suitable O-ring seal 229 which is adapted to effectively isolate the upper end of chamber 229 from the lower end thereof. A spring 230 disposed in the lower end of said valve chamber serves to continuously bias the valve member 225 to its said upper operative FIG. 3 position as determined by the sealing engagement of the circular edge 231 thereof with the adjacent tapered end walls 232 of the valving chamber; the lower or second operative position of the valve member being determined by the engagement of lower end 233 thereof with the upper adjacent surface 234 of said plug 222. The area of the upper end face 235 of the valve member and the effective strength of spring 230 are selected so that only after the desired pressure level is reached in line 64*a* will the valve member 225 be moved down and away from its said normal upper position and towards its said lower position thereby allowing pressure fluid to flow as indicated by arrows 205 to the main fluid motor means so as to produce an index stroke of said feed slide 23. As will be seen this time delay generated by the pressure build up requirement at valve 200 will allow the stock clamping means 70 to be actuated and the gripping means 37 to be released slightly before the initiation of said index stroke as is desired. When the fluid pressure in line 64*a* drops by reason of the closing of the main valve means 36 the spring 230 will restore the valving member 225 to its said normal upper position shown in FIG. 3. One functional advantage of the above described construction of the inlet valve 200 is that as soon as the valve is opened full pressure fluid flow may immediately take place in an unobstructed direct path through the open upper end of chamber 220 from line 64*a* to line 64*b*; this feature serving to improve the response time and speed characteristics of the feeder.

Figure 4:
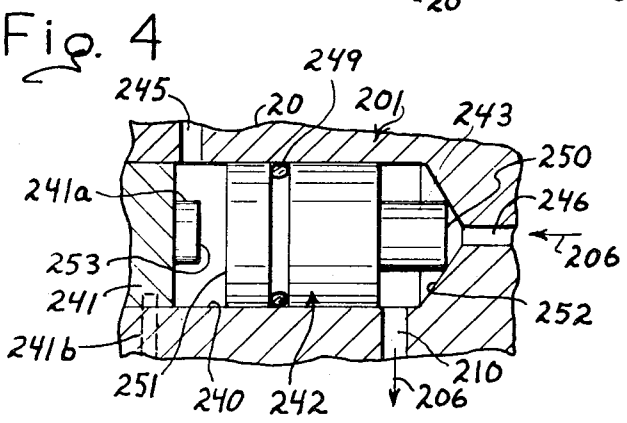
FIGS. 3 and 4 are axial sectional views respectively illustrating the structural details of the novel pressure responsive inlet and exhaust valves used in the circuit illustrated in FIG. 2.

The details of the differential pressure exhaust valve 201 will now be described in connection with FIG. 4 wherein a valve chamber 240 formed in the main body 20 has its left end, as seen in FIG. 4, sealed by any suitable plug 241 that is formed with an inner stop shoulder 241*a*. Disposed in said valve chamber is a cylindrical valve element 242 of circular cross sectional profile and having a reduced right end 243. Valve element 242 is provided with O-ring seal 249 whereby the right and left ends of chamber 240 are effectively mutually pneumatically isolated. The left end of chamber 240 as seen in FIG. 4 is connected to a control line 245. FIGS. 2 and 4, from line 64*a* while the right hand end thereof is coupled as indicated to a line 246, FIGS. 2 and 4, from the said line 64*b* and to said separate exhaust line 210, FIGS. 2 and 4. As will be seen the left end or face of valve element 242 will always be exposed through lines 245 and 64*a* to the fluid pressure in the output line 121 of the main valve means 36 while the right end or face of valve element 242 will always be exposed through lines 246 and 64*b* with the fluid pressure in the head end of the main fluid motor means 60, 61. The valve elements 242 is adapted to be pneumatically moved axially back and forth between its two operative positions which are respectively defined by engagement of the opposite ends 250 and 251 thereof with the effective opposite right and left end surfaces 252 and 253 respectively of the valve chamber 240. When at the start of an index stroke of the feed slide the pressure in main fluid motor means and thus in the lines **64*b* and 246 is low or ambient the left end of chamber 240 will become filled with pressure fluid from the main valve output line 121 through lines 64*a* and 245; the resultant differential fluid pressures thus developed across the ends of the valve element 242 will produce a force imbalance that will cause the element 242 to move to its right hand position shown in FIG. 4 so that exhaust flow from the head end of the main fluid motor means 60, 61 through lines 64*b* and 246 to the exhaust line 210 is blocked thereby enabling the supply of pressure fluid through valve 200 to the head end of the main fluid motor means so as to thereby produce the previously described index stroke of the feed slide 23. When, however, the main valve means 36 is closed and the fluid pressure in the output line 121 of the main valve drops the axial force generated by the pressure now acting on the right end face 250 of the valve element 242 will become greater than the force generated by such reduced pressure in line 245 on the larger area of the left end of the valve element 242 and the resultant force imbalance produced will cause the valve element to now move to its said left hand position wherein pressure fluid from the main fluid motor means may exhaust through said line 246, the right end of valve chamber 240 and the exhaust line 210 as indicated by arrows 206. This differential force or pressure technique for actuating the valve element 242 affords the advantage that in the circuit shown the latter can accommodate a wider range of feeder air supply pressures than when the shifting of the valve element is tied to a generally fixed force such as that afforded by a mechanical spring. The pressure levels at which the valve 201 opens will largely depend on the relative effective cross sectional areas of the valve chamber 240 and the reduced end 250 of the valve element 242**.

Figure 1:
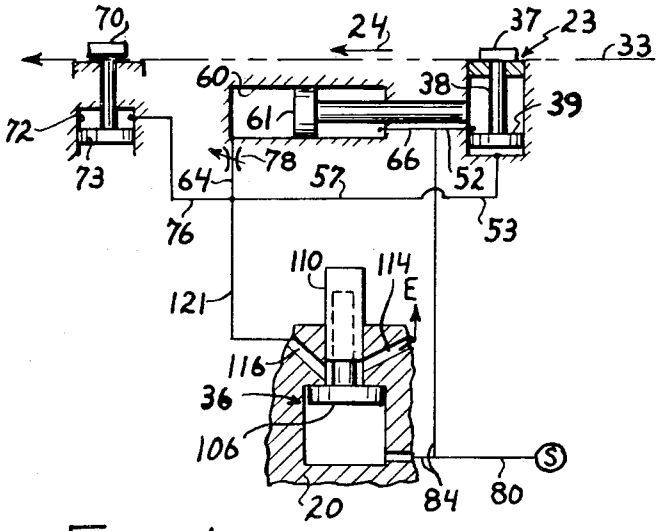
Fig. 1 PRIOR ART
FIG. 1 is a circuit diagram corresponding to the circuit diagram illustrated in FIG. 13 of my prior U.S. Pat. No. 3,329,327.

With the above described valves 200 and 201 incorporated as shown in the FIG. 2 control circuit not only is the above noted desired proper sequencing of operation of the stock clamping and gripping means with respect to the movement of the feed slide obtained over a wider range of operational speeds, but the control arrangement as a whole, i.e., the above described combination of the three valves means 36, 200 and 201, will tolerate a relatively wide range of manual set-up variations so that the press operator need not be so precise in the manual positional setting of the "striker" carried by the press ram and by which the plunger 110, FIGS. 1 and 2 of the main valve means 36 is vertically actuated, and by which the operation of the feeder is synchronized with the operation of the press with which the feeder is to be used. These features greatly facilitate the set-up and operational efficiencies of the feeder. Any suitable means such as a set screw, roll pin or the like may be used to retain the fluid pressure sealing plugs 222 and 241 is their positions shown as is illustrated respectively at **222*a* and 241*b* of FIGS. 3 and 4**.

It will be noted that when the valve member 225 is in its normal upper FIG. 3 position the outlet port 237, FIG. 3, defined by the junction of line **64*b* with the side of valving chamber 220 is covered in a spool valve manner by the center portion 228 of the valve member 225, while the inlet port 239 defined by the junction of the line 64*a* with the end of chamber 220 is effectively closed in a poppet valve manner by the upper end edge 231 of said valve member 225**.

Figure 8:
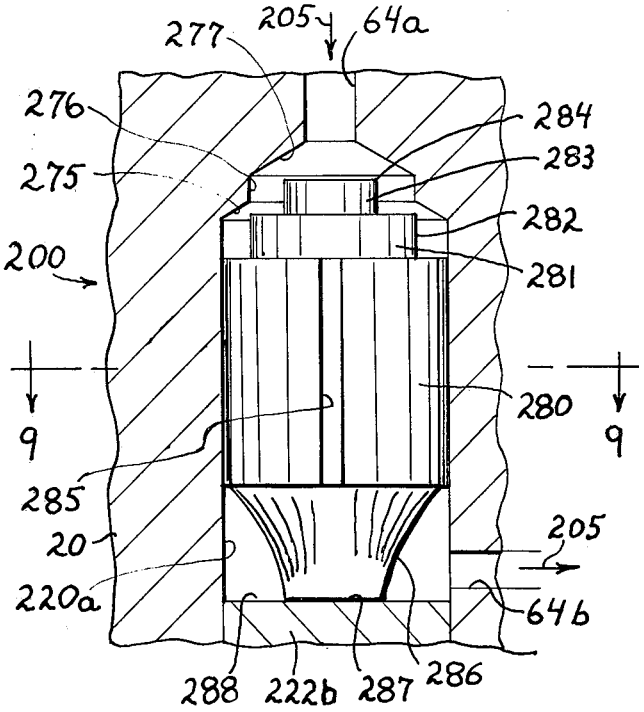
FIG. 8 is a somewhat enlarged axial sectional view corresponding to FIG. 3 and shows a preferred modified construction for the inlet valve of the pneumatic circuit of FIG. 2.
Figure 9:
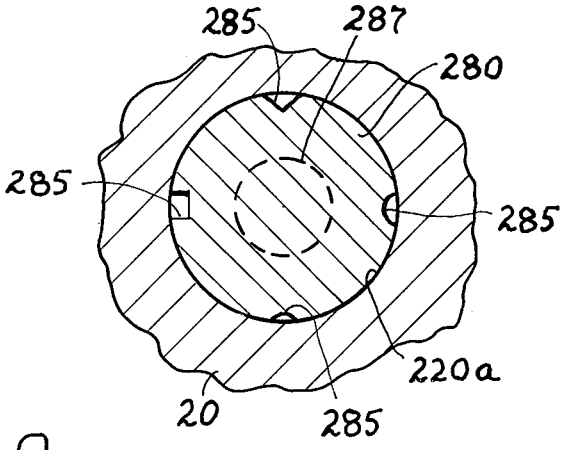
FIG. 9 is a cross sectional view taken along section line 9—9 of FIG. 8.

A preferred form for the one-way inlet valve 200 of FIG. 2 is illustrated in FIGS. 8 and 9 wherein the spring 230, O-ring 229 and vent hole 221 associated with the FIG. 3 inlet valve may be eliminated by using a pneumatically movable shuttle in the valving chamber. Here the cylindrical valving chamber or bore **220*a* formed in the body 20 is plugged at its lower end, as seen in FIG. 8, by means of a suitable fluid pressure sealing plug 222*b* that is secured in its operative position shown in any suitable manner such as that for said plug 222. Plug 222*b* has no vent hole such as at 221 of FIG. 3 and at its upper end is formed with first a tapered or conical surface 275, then a reduced cylindrical valving surface 276 and then another tapered or conical valving surface 277 which terminates at the inlet line 64*a*. Axially movably disposed in said valving chamber 220*a* is a cylindrical valve shuttle or member 280; the upper end of which is formed with a first reduced cylindrical portion 281 having a cylindrical spool valve type outer valving surface 282 and a second further reduced portion 283 having an upper outer circular valving edge 284. The cylindrical outer surface of the central portion of the valve member 280 is formed with a plurality of longitudinal extending grooves or channels 285, FIGS. 8 and 9, while the lower end 286 of the valve member arcuately tapers as shown down to a lower end face 287 that is adapted to move into and out of abutting engagement with the adjacent upper end surface 288 of said plug 222*b***.

In operation, when pressure fluid is directed through inlet line **64*a* and into the upper end of valving chamber 220*a*, the valve shuttle 280 will be immediately displaced to its lower operative FIG. 8 position as determined by engagement of said end face 287 of the valve shuttle with the said plug face 288 whereby pressure fluid may flow from the upper portion of valving chamber 220*a* through said valve member channels 285 to the lower end of said valving chamber and out through line 64*b* as indicated by arrows 205 to thereby produce an index stroke of the feed slide 23 as that is described above in connection with FIG. 3. When the fluid pressure in line 64*a* and the upper end of chamber 220*a* drops by reason of the main valve closing the now greater fluid pressure in the lower end of chamber 220*a* will cause the valve member or shuttle 280 to immediately move upwardly to its second operative or fluid flow blocking position wherein pressure fluid is prevented from flowing from line 64*b* and chamber 20*a* into line 64*a*. In moving to this second or upper operative position the cylindrical valving surface 282 on the shuttle first moves into sliding valving engagement with the cylindrical valving surface 276 of the valve chamber in a spool valve manner so as to thereby cut off substantially all fluid flow from the bottom to the top of the valving chamber 220*a* and thereafter the upper outer circular valving edge 284 on the end of the shuttle engages the conical valving surface 277 of the valving chamber 220*a* in a poppet valve manner so as to thereby finally seal the valve unit 200 of FIG. 8 in its closed condition for and during the ensuing feed stroke of the feed slide 23 that is described above in connection FIG. 3. The plurality of cooperating pairs of valving surfaces, i.e. 282 with 276 and 284 with 277 will insure a tightly closed condition for the valve unit when said valve shuttle moves to and is held in its said upper operative position by the now higher fluid pressure existing in the lower end of said valve chamber 220***a*. The cross sectional configuration of the channels 285 may be round, rectangular, flat or other shape, as is illustrated in FIG. 9, and/or may actually extend through an interior portion of the said central portion of the valve member 280.

Figure 5:
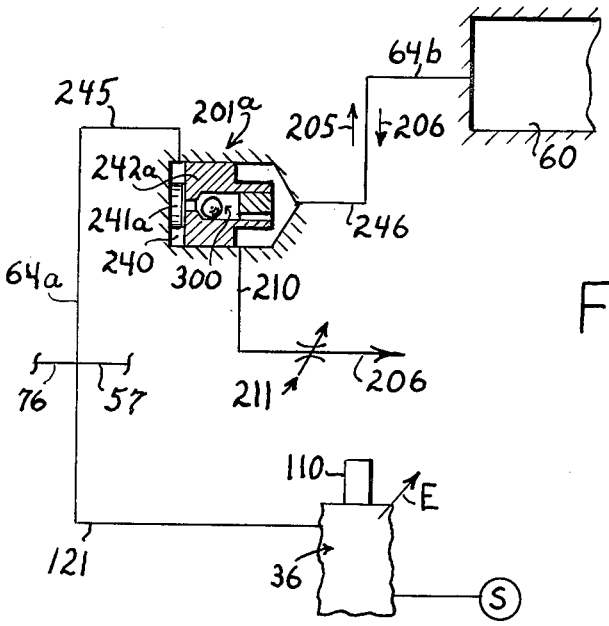
FIG. 5 is a circuit diagram for a modified version of the present control system.
Figure 6:
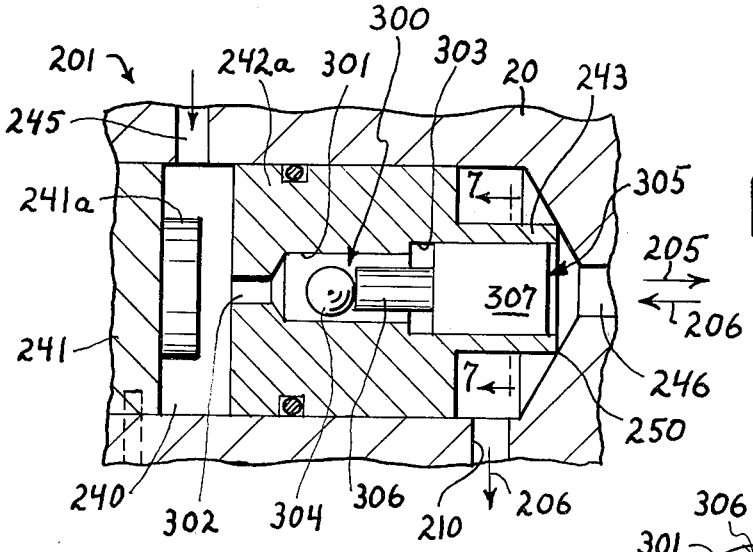
FIG. 6 is an axial sectional view showing structural details of a modified exhaust and inlet valve arrangment.

FIG. 5 shows a circuit diagram for a modified form of the control valve arrangement for the present invention whereby the one-way inlet valve unit 200, FIG. 2, is effectively built into and is thus carried by the valve unit 201 of FIG. 2. Unles otherwise indicated like reference numerals in FIGS. 1–7 here again designate like structure and function. The differential pressure valve 201*a*, FIG. 5, is similar to the differential pressure valve 201 of FIGS. 2 and 4 except that it carries a one-way inlet valve unit 300. Valve element 242*a* of FIG. 5 controls the exhaust flow 206 of pressure air from the main cylinder as above described for the valve element 242 however valve element 242*a* carrying the one-way inlet valve unit 300 is capable of conducting pressure fluid therethrough from left to right as seen in FIGS. 5 and 6, i.e. from lines 64*a* and 245 through valve 242*a* to the line 246; fluid flow in the other direction, i.e. from right to left as seen in FIG. 5, through valve element 242*a* being prevented by the operation of the one-way valve unit 300. With this arrangement when the plunger 110 of the main three-way valve 36 is depressed by the action of the press ram to initiate an index stroke of the feed slide 23 pressure fluid will flow through the output line 121 of main valve 36 to lines 64*a* and 245 and to the left end of chamber 240, FIG. 5, of the valve 201*a* whereby the resultant higher fluid pressure on the left end of the element 242*a* will cause the latter to immediately move from its left hand position shown in FIG. 5 to its right hand position illustrated in FIG. 6 so as to prevent flow of pressure fluid from lines 246 or 245 out through exhaust line 210. With the valve element 242*a* in this right hand position pressure fluid in the left end of chamber 240 may now flow through the one-way ball valve unit 300 to line 246 and thus to the main cylinder 60 through line 64*b* as indicated by arrows 205 in FIGS. 5 and 6 so as to thereby cause the feed slide to move through an index stroke. When the plunger 110 of the main valve 36 is restored to its normal upper position output line 121 will be exhausted so that after the clamps have thereby operated as above described the fluid pressure in the left end, as seen in FIG. 5, of chamber 240 will be lowered sufficiently to permit the fluid pressure now acting on the right end of valve element 242*a* to move the latter to its left hand position illustrated in FIG. 5 wherein reverse air flow is prevented from taking place through valve element 242*a* by the action of said one-way valve unit 300 but exhaust flow from the main cylinder 60 through line 246 will be now permitted to take pace through exhaust line 210 as indicated by arrow 206 and in the manner described above in connection with the operation of the valve element 242 of FIGS. 2 and 4.

Figure 7:
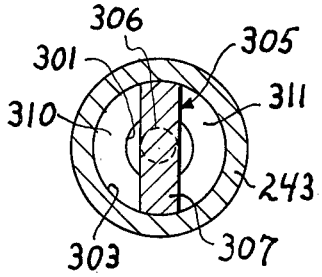
FIG. 7 is a cross sectional view taken along section line 7—7 of FIG. 6.

The structural details of the pressure responsive one-way inlet ball valve unit 300 will now be described with reference to FIGS. 6 and 7. The valve element 242*a* is formed with a central axial bore 301 communicating at its left end as seen in FIG. 6 with a reduced inlet orifice 302 and at its opposite end with a slightly enlarged counter-bore 303. Disposed adjacent to the conical end walls at the left end of bore 301 is a valve shuttle or ball member 304 having a diameter greater than that for orifice 302 but less than that for bore 301. The ball 304 is retained in bore 301 by means of a plug member 305 which is formed with an inner cylindrical nose 306 and which has an outer plate-like end 307 that is press fitted into said counter-bore 303 thereby defining longitudinal pressure fluid flow passages 310 and 311, FIG. 7, through the reduced right hand end 243 of valve element 242*a*. When the effective fluid pressure force is greater on the right side than on the left side of the ball 304 the ball will move to its left hand position against the conical end walls of bore 301 so as to prevent reverse fluid flow, i.e. from right to left, through the valve element 242*a*, however when the effective fluid pressure force on the left side of ball 304 is greater than that on the right side thereof the ball will move to its right hand position against the inner end of retainer nose 306 so that pressure fluid may then flow through valve element 242*a*, i.e. through orifice 302, bore 301, passages 310, 311 of counter-bore 303 and line 246 to the main cylinder 60.

As will be seen then the one-way ball valve unit 300 carried by element 242*a* of FIGS. 5 and 6 produces the same effective one-way fluid inlet control function in the circuit of FIG. 5 as the one-way valve unit 201 does in the circuit of FIG. 2. Here no spring is used to bias the ball 304 to a valve closing position, rather the ball is shuttled back and forth between its said two operative position by just the varying differential fluid pressures acting on opposite side thereof. Any one or more of the above described movable valve elements or members may be made from a durable plastic material such as nylon, and a shuttle valve member with an associated valving chamber configuration such as is illustrated in FIG. 8 may be used at the right end of the FIG. 4 exhaust valve unit and/or at the left end of the one-way FIG. 6 inlet valve unit 300.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. A pneumatically operated stock feeder for intermittently advancing stock into the work station of a punch press or the like: comprising a frame;

a feed slide reciprocally carried by said frame for movement in feed and index directions;

stock gripping means carried by said feed slide;

a main double-acting fluid motor means carried by said frame for reciprocally actuating said feed slide;

a second double-acting fluid motor means carried by said feed slide for actuating said stock gripping means between stock gripping and stock release conditions;

said main and second double-acting fluid motor means each having a head end and a rod end;

fluid conduit means adapted and arranged to enable supply pressure fluid to be continuously applied to the rod ends of both said main and second double-acting fluid motor means so as to thereby continuously bias said double-acting fluid motor means so that said stock gripping means is normally moved to a stock gripping condition and said feed slide is normally moved in a stock feed direction;

pneumatic control means for controlling the supply and exhaust of pressure fluid to and from the said head ends of both said main and second double-acting fluid motor means so that alternate index and feed strokes respectively of said feeder may be executed;

said control means including a main normally closed three-way control valve, said main control valve including means defining an output line through which pressure fluid is adapted to be supplied and exhausted to and from the head end of said second double-acting fluid motor means on said feed slide in response to the opening and closing respectively of said main control valve;

means defining a separate exhaust line for the said head end of said main fluid motor means; a fluid pressure controlled inlet valve means shiftable between a first open condition and a second closed condition for respectively peermitting and blocking the flow therethrough of pressure fluid during the supply and exhaust, respectively, of pressure fluid to and from the head end of said main fluid motor means, said inlet valve means being adapted to be shifted to its said first open condition in response to a flow of pressure fluid into said main valve output line whereby pressure fluid will then be supplied (a) through said main valve output line to the head end of said second double-acting fluid motor means so as to cause said stock gripping means to move to a stock release condition, and (b) through said inlet valve means to the head end of said main double-acting fluid motor means so as to cause said feed slide to move in an index direction, said movements of said stock gripping means and said feed slide both taking place against the said continuous fluid biasing action at the rod ends of said second and main double-acting fluid motor means respectively so that an index stroke of the feeder is thereby executed;

a fluid pressure controlled exhaust valve means shiftable between a first closed condition and a second open condition for respectively blocking and permitting the exhaust flow therethrough of pressure fluid from the head end of said main fluid motor means to said separate exhaust line, said exhaust valve means being adapted to be shifted to its said second open condition in response to the exhaust of pressure fluid from said main valve output line, whereby pressure fluid will then be exhausted (a) through said main valve from the head end of said second double-acting fluid motor means so as to cause said stock gripping means to move to a stock gripping condition, and (b) through said exhaust valve means from the head end of said main fluid motor means to said separate exhaust line so as to cause said feed slide to move in a feed direction, said last mentioned movements of said stock gripping means and said feed slide both taking place under the action of said continuous fluid biasing action so that a stock feed stroke of the feeder is thereby executed;

said exhaust valve means being disposed in its said first and second conditions when said inlet valve means is disposed in its said first and second conditions respectively; and actuating means responsive to (a) the flow of pressure fluid into the said main valve output line for causing said exhaust valve means to be shifted to its said exhaust flow blocking condition, and (b) the exhaust of pressure fluid from said main valve output line for causing said exhaust valve means to be shifted to its said exhaust flow permitting condition.

2. Apparatus as defined by claim 1 wherein said inlet valve means includes a movable valve member having an operative valving surface formed thereon that is adapted to be moved between open and closed positions by the movement of said valve member, wherein said exhaust valve means includes a movable valve element having an operative valving surface formed thereon that is adapted to be moved between open and closed positions by the axial movement of said valve element, and wherein said movable valve member is carried by said movable valve element for movement with the latter.

* * * * *